United States Patent [19]

Wilson et al.

[11] Patent Number: 4,812,137

[45] Date of Patent: Mar. 14, 1989

[54] CONNECTOR WITH EMI/RFI GROUNDING SPRING

[75] Inventors: Albert H. Wilson, Los Angeles; David E. Welsh, Tustin, both of Calif.

[73] Assignee: ITT Corporation, New York, N.Y.

[21] Appl. No.: 125,273

[22] Filed: Nov. 25, 1987

[51] Int. Cl.[4] ..... H01R 9/00; H01R 13/658

[52] U.S. Cl. ..... 439/607; 439/904

[58] Field of Search ..... 439/607-610, 439/904; 333/182, 183

[56] References Cited

U.S. PATENT DOCUMENTS

| | | | |
|---|---|---|---|
| 3,521,222 | 7/1970 | Andrews . | |
| 3,587,029 | 6/1971 | Knowles . | |
| 3,897,125 | 7/1975 | Anderson . | |
| 4,106,839 | 8/1978 | Cooper . | |
| 4,470,657 | 9/1984 | Deacon . | |
| 4,516,815 | 5/1985 | Venable et al. . | |
| 4,544,227 | 10/1985 | Hirose . | |
| 4,571,012 | 2/1986 | Bassler et al. . | |
| 4,601,527 | 7/1986 | Lemke | 439/608 X |
| 4,623,211 | 11/1986 | Dambach et al. . | |

FOREIGN PATENT DOCUMENTS 2098412 11/1982 United Kingdom ..... 439/609

OTHER PUBLICATIONS

ITT Cannon catalog D*Sub 1/1184 entitled "D Subminiature", 1984.

*Primary Examiner*—Paul Gensler

*Attorney, Agent, or Firm*—Thomas L. Peterson

[57] ABSTRACT

A connector is described, which includes a radio interference shield in the shell assembly, and yet which has a shell assembly whose forward portion can fit into a very narrow space. The shell assembly includes a shell (14, FIG. 2), a sheet metal hood (30) extending forwardly from the shell to receive another connector, and a sheet metal shield (34) lying on the inner shide of the hood. The hood has a forward end (46) extending in a short loop, while the shield has a forward end (58) extending in a loop immediately rearward of the hood loop. The shield includes an outer portion (54) extending along the inner surface of the hood, and a resilient inner portion (56) that forms spring fingers (62) that contact the other connector and that have tips (78) that make facewise contact with the outer portion of the shield.

8 Claims, 2 Drawing Sheets

FIG. 1
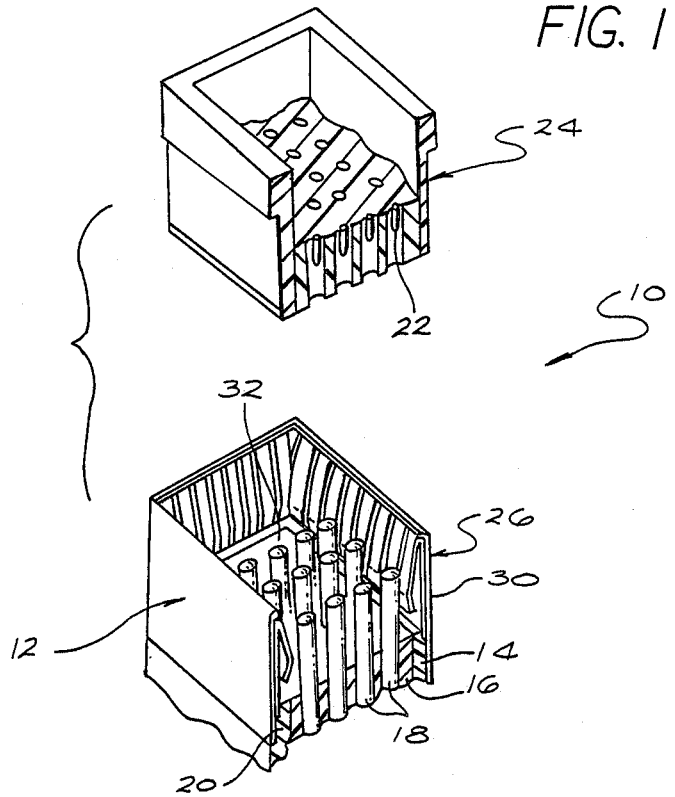
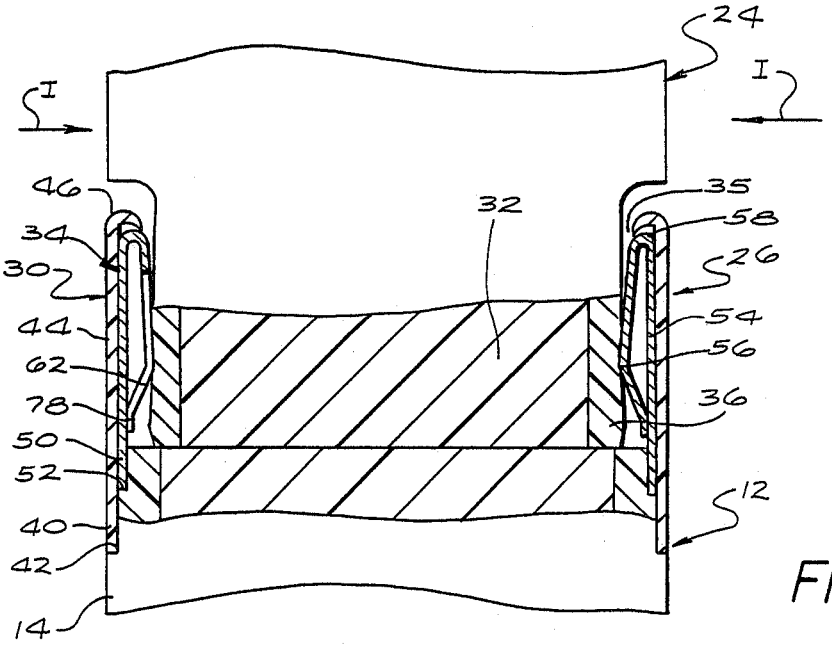
FIG. 2

FIG. 3
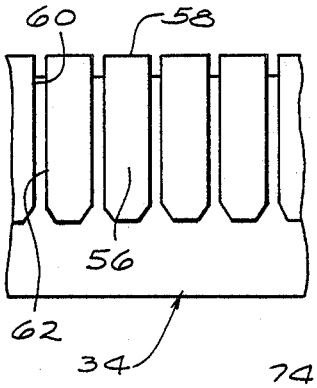
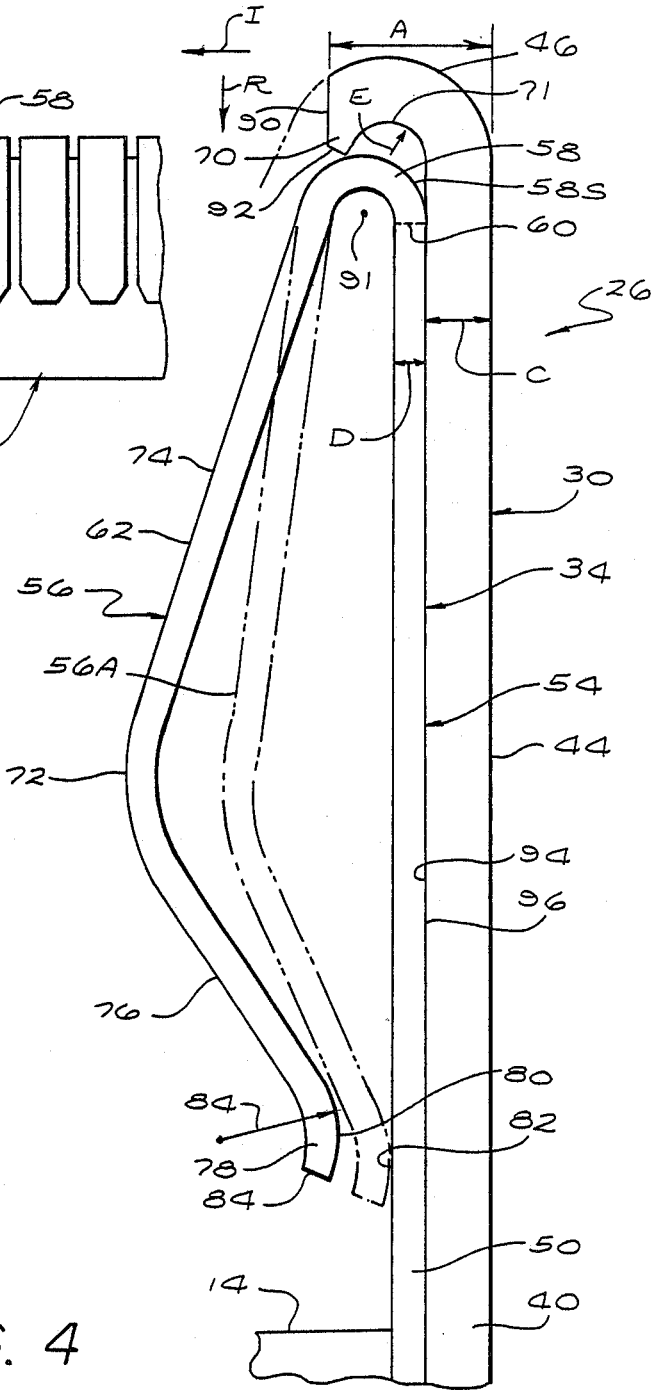
FIG. 4

CONNECTOR WITH EMI/RFI GROUNDING SPRING

BACKGROUND OF THE INVENTION

One type of electrical connector includes multiple terminals or contacts lying in a block of insulative material, and a shell assembly surrounding the insulative material. The shell assembly includes a hood that extends forwardly from a shell to receive another connector having mating contacts. Where radio interference is a problem, an EMI/RFI (electromagnetic interference and radiofrequency interference) shield is desirable to bridge the gap between the hood and the mating connector, to ground any currents induced by radio waves so they do not appear on the mating contacts. Where the connector is to include such a shield and must fit into a narrow space, problems can arise in making the hood portion of the shell assembly thin enough. One possibility is to form the hood of resilient material and to slit it to form resilient fingers. However, slitting of the hood weakens it, and provides too easy access for radio interference as well as for damaging objects. A connector with a thin hood portion that included an effective EMI/RFI shield, as well as a reliable and highly protective hood, and which was of small thickness, would be of considerable value.

SUMMARY OF THE INVENTION

In accordance with one embodiment of the present invention, a connector is provided whose hood portion is thin and yet includes an effective and reliable EMI/RFI shield. The connector includes a shell, a hood extending forwardly from the shell and an EMI/RFI shield lying within the hood. The hood is formed of sheet metal with a forward end bent into a loop. The shield is also formed of sheet metal, and has a looped forward end lying rearward of the looped end of the hood, the shield also including a resilient inner portion that can contact another connector.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partial perspective and sectional view of a connector constructed in accordance with the present invention, shown in conjunction with a mating connector.

FIG. 2 is a sectional side view of the connector of FIG. 1, with the mating connector shown in a mated configuration.

FIG. 3 is a partial front view of the EMI/RFI shield of the connector of FIG. 2.

FIG. 4 is an enlarged view of a portion of the connector of FIG. 2.

DESCRIPTION OF THE PREFERRED EMBODIMENT

FIG. 1 illustrates a connector 10 of the present invention, which includes a shell assembly 12. The shell assembly includes an electrically grounded shell 14 that surrounds a body 16 of insulative material that holds a group of electrical terminals or contacts 18. The contacts have forward ends extending from a forward end 20 of the shell, that are designed to mate with corresponding contacts 22 of a mating connector 24. The shell assembly of the connector 10 includes a hood portion 26 extending forwardly from the forward end of the shell. The hood portion lies outward of the contacts 18, and is designed to receive a portion of the mating connector, to guide it to ensure alignment of the connectors during mating, and to surround and safeguard the region where the contacts of the two connectors mate.

In some applications, care must be taken to prevent electromagnetic radiation in the environment from leaking through any appreciable gap between the mating connectors, and inducing currents in the contacts. This can be accomplished by providing sheet metal springs that fit in the gap between the connectors. However, in some situations the space available to be occupied by the hood and any shield is narrow, as where the allowable space was fixed when a connector without a shield was designed. It would be possible to use a hood of spring sheet metal with slots to form it into numerous contact fingers. However, the slots in such a hood weaken it and also provide long gaps through which interfering electromagnetic energy can pass.

In accordance with the present invention, the hood portion 26 (FIG. 2) of the shell assembly includes a sheet metal hood 30 which provides considerable mechanical and electromagnetic wave protection for the receiving region 32 where the mating connector is received, as well as an EMI/RFI shield 34 that bridges the gap 35 between the shell assemblies 12, 36 of the connectors to prevent the leakage of electromagnetic energy therein.

The hood 30 includes a rearward end 40 mounted on the shell 14, in a cutout 42, by soldering, brazing, or welding to provide electrical contact as well as mechanical connection between them. The hood has a middle portion 44 extending forwardly from the rearward end, and has a forward hood end 46 extending inwardly (in the direction of arrow I) in a loop to form a looped forward hood end or internal flange. The shield 34 has a rearward end 50 which is mounted the hood and shell, by lying in another cutout 52 in the shell, where the shield rearward end is soldered, brazed or welded in place. The shield includes outer and inner portions 54, 56 connected by a looped forward shield end 58. The outer shield portion 54 extends substantially facewise against the hood middle portion 44, while the inner shield portion 56 is spaced inwardly from the outer shield portion and is intended to deflect. The shield is formed of sheet metal, and has slots 60 (FIG. 3) extending in the looped forward shield end 58 and along the entire inner shield portion 56 to form the inner shield portion 56 into numerous resilient fingers 62.

Certain parts of the hood portion 26 of the connector 12 have to be guarded against damage. The extreme front end of the hood is a part that is subject to localized stresses that could permanently deform it. Although the hood 30 is of moderately thin sheet metal, the fact that its forward end is looped results in an increased thickness A (FIG. 4) at the front end which stiffens the front of the hood against inward and outward deflection. Another source of damage to shielded connectors, is that persons sometimes try to insert pins or other probes to bend a shield portion if is believed that a shield finger is not making proper contact. The use of such probes by inexperienced personnel often leads to additional damage to the shield fingers, which could otherwise operate properly. The looped forward hood end 46 provides a guard over the outer side 58s of the looped forward shield end 58, to resist the insertion of a pin or probe between the shield and the hood that might be used for "picking" to pry them apart. It might be desirable if the hood forward end 46 could extend completely around the shield looped forward end 58, but this would result in an increased thickness for the hood, and the available space may be very limited. The fact that the hood includes a portion that extends not only inwardly in the direction of arrow I, but also a tip 70 that extends rearwardly in the direction of arrow R further than t he center of the loop 71, results in the guarding of the shield outer side 58s.

The inner shield portion 56 includes a contact region 72 where it makes wiping contact with the shell assembly of the mating connector. The inner shield portion also includes a front part 74 extending between the looped forward shield end and the contact region, and a rear part 76 extending rearwardly from the contact region 72. The rear part includes a tip 78 with an inner surface 80 that makes facewise contact with an outer surface 82 on the outer shield part 54, the two surfaces being tangent when in contact. The inner surface 80 is rounded about a radius of curvature 84 much greater than the thickness of the shield, to provide good electrical contact. Only a very short extreme end 84 of the shield extends beyond the inner surface 80. It is important that when the connectors are mated so the shield inner portion is deflected to the position 56A, that contact be made at 80, 82. Otherwise, the long shield fingers 76 that were not grounded at their ends, would reradiate into the inside of the connector any radio waves picked up by them. The thickness C of the hood portion 26 of the shell assembly is relatively small, and yet it provides an independent hood 30 with a front end 46 of considerable width A to provide rigidity, and also provides a closed-path grounded shield 34 that reliably contacts the shell of another mating connector, with the shield protected against "picking" that could harm it.

Applicant has constructed connectors of the type illustrated, using a hood 30 formed of nickel (stainless steel is also suitable) of a thickness C of 16 mils (1 mil equals one-thousandth inch) and a shield 34 of beryllium copper having a thickness D of 8 mils. The forward hood end 46 was bent about a radius E of 9 mils over an angle of 150°, and the inner end of the looped forward end was formed with a flat inner surface at 90, to limit the width A of the hood. The inner surface 90 lies inward of the center of curvature 91 of the shield outer wall end. Another flat 92 wa formed at the end of the loop. The tip 70 of the hood is used to locate the shield forward end. The inner surface 94 of the hood middle portion is used to locate the shield in inward-outward direction by facewise contact with a shield outer surface 96. The rearward ends 40, 50 of the hood and shield are soldered (brazing and welding are also suitable) together and to the shell 14 of the connector.

Thus, the invention provides a connector with a hood portion that protects the hollow forward receiving region of the connector while providing effective electromagnetic shielding, in a thin space. The hood portion includes a hood of sheet metal with a rearward end mounted on the shell of the connector and a forward end that extends in a loop. The hood portion also includes a shield in the form of sheet metal with an outer shield portion lying facewise against the inner surface of the hood, a looped forward shield end lying closely rearward of the hood forward end, and an inner shield portion which extends rearwardly and inwardly to a contact region and then rearwardly-outwardly to a tip. When the connectors are mated, the tip of the shield inner portion makes facewise contact with the outer shield portion.

Although particular embodiments of the invention have been described and illustrated herein, it is recognized that modifications and variations may readily occur to those skilled in the art and consequently it is intended to cover such modifications and equivalents.

What is claimed is:

1. A connector comprising:

connector shell having a forward end;

an insulative body within said shell;

a plurality of contacts mounted in said body and having forward ends at said forward shell end;

a hood mounted on said shell and extending forwardly therefrom, said hood having an inside closest to said contacts and an outside;

an interference shield having an outer portion lying against said inside of said connector hood and having an inner portion for making wiping contact with the shell of another connector;

said connector hood having a rearward end mounted on said shell, said hood extending forwardly therefrom and then inwardly in a loop to form a looped forward hood end;

said shield having a looped front end lying rearward of said looped hood forward end and connecting said shield inner and outer portions, said shield inner portion having a front part extending rearwardly and inwardly from said shield looped forward end and forming a contact region, and including a rear part extending rearwardly and outwardly from said contact region.

2. The connector described in claim 1 wherein:

said shield inner portion includes a rearward tip with an inner surface that lies in facewise contact with said shield outer portion when said connectors are mated.

3. The connector described in claim 1 wherein:

said shield is in the form of a sheet of spring metal with slits, said slits each starting from about the outer side of said shield looped front end and continuing around said looped front end of said shield and dividing said shield inner portion into a plurality of resilient fingers.

4. The connector described in claim 1 wherein:

said hood is formed of sheet metal of substantially uniform thickness and has an elongated portion extending forwardly from said hood inner end to said forward hood end, said looped forward hood end is curved by more than 90° but less than 180°, and said looped forward hood end has a substantially flat inner surface extending substantially parallel to said hood middle portion.

5. The connector described in claim 1 wherein:

said shield looped front end lies substantially against the inner end of said looped forward hood end.

6. In a connector which includes a shell having a forward end, an insulative body within said shell, and a plurality of contacts mounted in said body, and constructed to mate with another connector, the improvement comprising:

a hood formed of sheet metal, having a rearward end mounted on said shell, a middle portion extending forwardly of said shell and having an inner surface, and a forward end internal flange, said hood lying outward of said terminals;

a shield of sheet metal having an outer portion lying against said inner surface of said hood middle portion, and an inner portion extending inwardly of said hood forward end flange; and said shield having a forward shield end extending in a loop and lying rearward of said hood forward end flange, said shield inner portion extending rearwardly from said shield forward end flange, said shield inner portion having a tip positioned to facewise engage said shield outer portion.

7. The improvement described in claim 6 wherein:

said shield outer portion has a rearward end, and said hood rearward end and said shield rearward end are both bonded to said shell.

8. In a connector which includes a shell having a forward end, an insulative body within said shell, and a plurality of contacts mounted in said body, and constructed to mate with another connector, the improvement comprising:

a hood formed of sheet metal, having a rearward end mounted on said shell, a middle portion extending forwardly of said shell and having an inner surface, and an forward end extending in a loop, said hood lying outward of said terminals;

a shield of sheet metal having an outer portion lying against said inner surface of said hood middle portion, and an inner portion extending inwardly of said hood forward end; and said hood being formed of a metal of a first thickness C, said looped forward end having a width A in an inward direction of more than twice said thickness C, and said loop of said hood forward end extending by more than 90° to form a tip at the inner end of the loop that extends rearward of the center of loop, and said forward shield end lying substantially against said tip of said hood forward end.

* * * * *